United States Patent [19]

Blewitt

[11] 4,369,420

[45] Jan. 18, 1983

[54] CURRENT LIMITING FUSE WITH ACTUABLE EXTERNAL MEANS

[75] Inventor: Donald D. Blewitt, Penn Hills Township, Allegheny County, Pa.

[73] Assignee: Westinghouse Electric Corp., Pittsburgh, Pa.

[21] Appl. No.: 153,391

[22] Filed: May 27, 1980

[51] Int. Cl.[3] ..... H01H 71/20

[52] U.S. Cl. ..... 337/148; 337/161

[58] Field of Search ..... 337/158, 159, 160, 161, 337/162, 163, 164, 165, 148

[56] References Cited

U.S. PATENT DOCUMENTS

| | | | |
|---|---|---|---|
| 2,294,767 | 9/1942 | Williams | 337/161 X |
| 3,243,552 | 3/1966 | Mikulecky | 337/162 |
| 3,287,525 | 11/1966 | Mikulecky | 337/161 |
| 3,304,387 | 2/1967 | Lindell | 337/162 |

*Primary Examiner*—George Harris

*Attorney, Agent, or Firm*—M. J. Moran

[57] ABSTRACT

A current limiting fuse with a fuse element disposed over relatively movable portions of a mandrel including movement means for moving the mandrel which means includes an actuating wire having an end portion extending out of the fuse casing which end portion is connected in parallel in an otherwise closed circuit with electrical leads extending to the fuse element.

6 Claims, 4 Drawing Figures

CURRENT LIMITING FUSE WITH ACTUABLE EXTERNAL MEANS

BACKGROUND OF THE INVENTION

1. Field of the Invention

This invention relates to a current limiting fuse having external means for actuating or initiating the operation of the fuse.

2. Description of the Prior Art

Two types of current limiting fuses for use with transformers are generally employed. One fuse is a full-range fuse connected in the primary circuit. The other fuse is a limited range back-up fuse in series with an under-oil expulsion link connected to the primary. Both of these fuses have limitations.

The full-range device has a melting time-current characteristic far too steep to coordinate with the usual transformer damage curve. The fuse is physically large and, at higher voltages, it has a limited current rating. Moreover, a full range fuse of contemporary design cannot successfully interrupt low currents which may occur when, for example, an unloaded transformer melts the fuse on inrush and then falls back to the exciting current level.

The link and back-up fuse combination provides a more desirable solution, because the link more nearly approximates the sloping long-time damage characteristic of the transformer and is capable of extinguishing relatively small over-currents. The back-up current limiting fuse clears higher current faults above the capability the link. However, one limitation involves a difficulty of successfully coordinating the fuse with the link at the desired current level. Another limitation is that an oil-immersed link precludes the drawout well utilization now coming into prominence in transformer usage.

Prior art patents which are generally related to the subject matter of this invention include the following U.S. Pat. Nos.: 2,599,646; 3,256,409; 3,743,994; 3,825,870; 3,840,836; 3,911,385; 3,925,745; 3,949,342; and 4,028,655.

SUMMARY OF THE INVENTION

In accordance with this invention a current limiting fuse is provided which comprises a tubular electrically insulating casing including spaced terminals which terminals preferably comprise electrically conductive ferrules at each end of the casing, mandrel means within the casing, one portion of which is movable relative to another portion thereof, a fuse element disposed on and between the two portions of the mandrel means and the fuse being in electrical continuity with the spaced terminals to effect electrical continuity therebetween until the fuse element opens, moving means for moving said one portion of the mandrel, an actuating wire connected at one end to the moving means and having electrical conductivity less than that of the fuse element, and extending from the interior of the casing and having the other end connected to external means for directing current through the wire when desired, whereby the movement means operates to move said one portion of the mandrel from said other portion to effect rupture of the fuse element.

The advantage of the current limiting fuse structure of this invention is that it provides better and more flexible protection without the limitations set forth above.

DESCRIPTION OF THE PREFERRED EMBODIMENT

Figure 1:
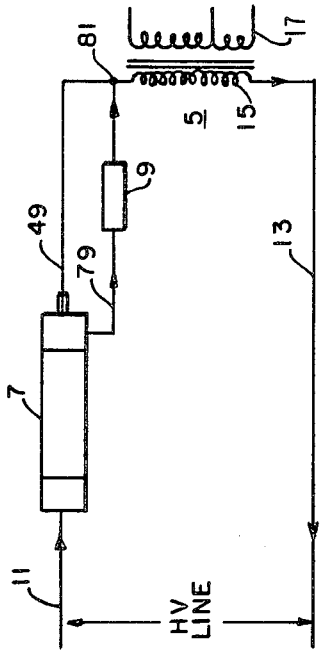
FIG. 1 is a circuit diagram showing one use of the invention in conjunction with a transformer primary.

A circuit diagram, as shown in FIG. 1, comprises a transformer 5, a current limiting fuse 7, and an overload device 9. The transformer 5 is disposed in a high-voltage AC line including conductors 11 and 13 and comprises primary windings 15 and secondary windings 17.

Figure 4:
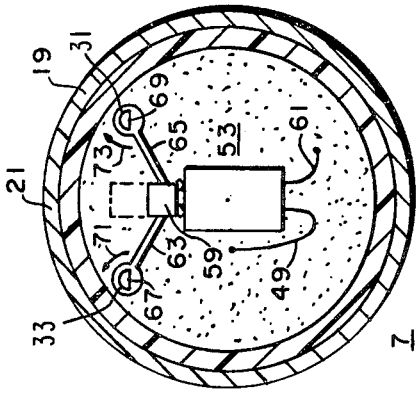
FIG. 4 is a vertical sectional view taken on the line IV—IV of FIG. 3.
Figure 3:
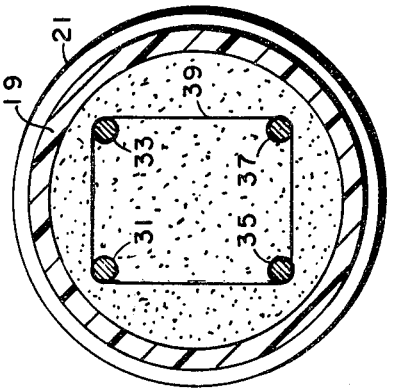
FIG. 3 is a vertical sectional view taken on the line III—III of FIG. 1.
Figure 2:
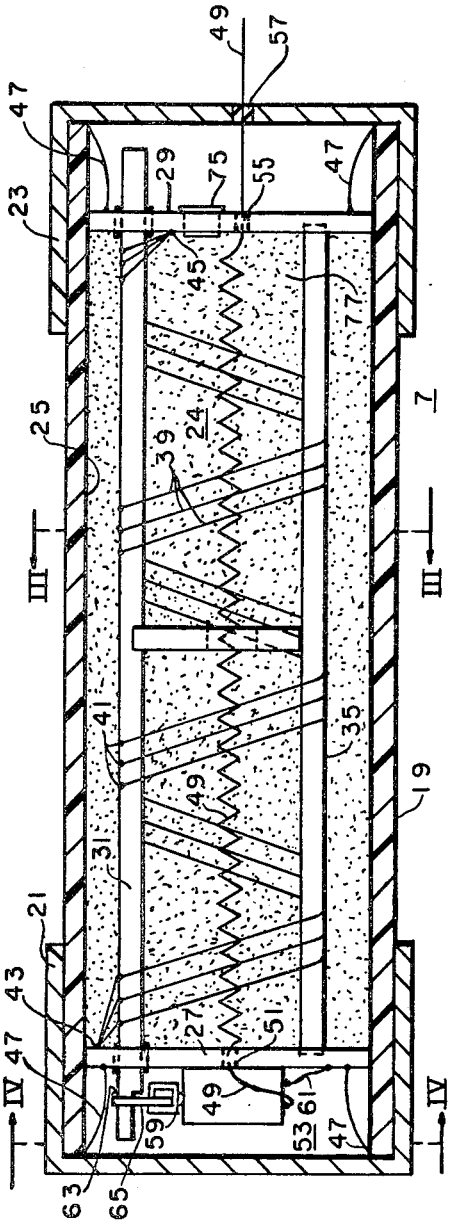
FIG. 2 is a horizontal sectional view of the fuse involved in this invention.

The fuse 7 is generally similar in construction and operation to that disclosed in U.S. Pat. No. 4,189,694, and because of the full description in that application, a limited description is included herein. Generally, the fuse 7 is a high-voltage current limiting fuse and comprises an elongated tubular housing or casing 19 (FIG. 2) which is typically made of electrically insulating material. The opposite ends of the housing 19 include end closure caps or ferrules 21, 23. The ferrules 21, 23 are comprised of electrically conductive material and serve as terminals for the fuse. The housing 19 encloses a fuse chamber 25 in which a mandrel 24 is disposed and supported at opposite ends by support plates 27, 29. The mandrel is comprised of a plurality, such as four spaced rods 31, 33, 35, 37 (FIGS. 2, 3, 4). The rods 31–37 are comprised of a dielectric material, such as high-strength alumina, or glass melamine. The support plates 27, 29, being electrically conductive, are preferably made of metal.

The fuse 7 also comprises a single or a number of fuse elements or wires 39 which are wound around the mandrel 24, or on and between the several rods 31–37. The fuse elements 39 are preferably disposed in transverse notches 41 (FIG. 2) in the several rods 31–37 for maintaining the elements in spaced positions with respect to each other. The ends of the fuse elements 39 are joined at common junctions 43, 45 (FIG. 2) on the support plates 27, 29, respectively. Similar jumper wires 47 interconnect the plates 27, 29 with the respective ferrules 21, 23. Thus, electrical continuity between the ferrules 21, 23 extends from the ferrule 21 through jumper wires 47, support plate 27, fuse elements 39, support plate 29, and jumper wires 47 to the ferrule 23.

The fuse 7 also comprises a trigger wire or actuating wire 49. The left end of the wire 49 (FIG. 2) extends through a dielectric bushing 51 in the plate 27 to a movement providing means 53 which is mounted on the side of the plate facing the ferrule 21. The opposite end of the wire 49 extends through dielectric bushings 55, 57 in the plate 29 and ferrule 23, respectively; that is, the right end of the actuating wire 49 extends out of the body of the fuse 7 to the exterior thereof without making direct electrical contact with the ferrule 23.

The movement-providing means 53 is a pyrotechnic device, such as an explosively operated plunger, including a small charge of an explosive (not shown) and a plunger 59 which is actuated by explosive charge which in turn is ignited by passage of current through wires 49 and 61 (FIG. 4), which lead into and out of the container of the charge. The movement-providing means 53 also comprises a pair of oppositely disposed links 63, 65 which are movably interconnected with the plunger 59 at one end and at the other end for keyed interlinkage with the rods 33, 31, respectively. Cutout openings 67 are provided at the ends of the links 63, 65 to provide flat surfaces 69 at the ends of the rods 33, 31, respectively, whereby movement of the links against the surfaces causes rotation of said rods in counterclockwise and clockwise directions as indicated by the arrows 71, 73 (FIG. 4). Thus, the fuse elements 39, disposed in the transverse notches 41 are stretched and severed.

As shown in FIG. 2, a plug 75 is provided in the plate 29. In the preferred embodiment of the invention, sand 77 or other pulverulent arc-quenching material is disposed in the fuse chamber between the plates 27, 29. After the fuse has been partially constructed, this region is then sealed off by insertion of the plug 75 in the end plate 29.

Inasmuch as the trigger or actuating wire 49 is a relatively thin, electrically conducting member having electrical conductivity less than that of the fuse elements 39, the wire 49 is insufficient to conduct appreciable amounts of current during normal non-blown condition of the fuse. Consequently, the movement-producing means 53 is not energized under normal non-overload fuse operation. The normal load current for transformer 5 (FIG. 1) passes through the conductor 11, the fuse 7, the conductor 79, and the overload device 9 to transformer primary winding 15 at junction 81.

The overload device 9 may be any one of a number of existing devices where a contact opening (or melting) occurs whenever predetermined thermal or other conditions are exceeded. Some examples of such a device are a thermostat sensitive to current, a thermostat sensitive to external temperature, a small low-voltage fuse of suitable melting characteristics, a relay attached to several remotely located sensors, such as thermal switches in the transformer core or oil, an oil expulsion link (used with the back-up fuse system), or a remotely located switch whereby fuse operation may be effected manually. One or more of these devices may be connected in series to provide multiple opening characteristics as desired. The device 9 is external of the fuse 7 but could be internal if desired. Moreover, devices 9 capable of automatic resetting may be permanently installed inside the transformer 5 with the fuse itself located in a drawout well.

In the foregoing embodiment, the actuating wire 49 extends out of the fuse through the dielectric bushing 57 and is connected to one side of the overload device 9 at junction 81. Thus, the wire 49 is connected to the load side of the device 9.

During low-current overloads, the overload device 9 gradually heats up according to its thermal characteristics and finally opens. The overload current transfers to the actuating wire 49, which is effectively in parallel with the circuit of the fuse-overload device series circuit, causing the explosive device in the movement-providing means 53 to operate, and thereby open the fuse elements 39 at a multitude of locations and therefore interrupting the circuit. On high-current overloads, the fuse 7 interrupts as an ordinary current limiting fuse in which case operation of the overload device 9 is of no consequence to the interruption, although the explosive device will activate as a matter of course. In the event that the fuse element 39 opens on low overload current conditions, the explosive device causes the fuse to interrupt through multiple element opening means.

Accordingly, the device of this invention provides for a transformer fusing system which provides better protection without the several limitations of prior systems. Moreover, it responds to high-fault currents in a manner similar to any normal current limiting fuse. Finally, it may be triggered into operation by any one of a number of external overload-sensing functions, including manual control.

What is claimed is:

1. A transformer-fuse system, comprising:
(a) a transformer and a fuse connected in a series circuit;
(b) the fuse having a tubular electrically insulating casing;
(c) a terminal at each end of the casing and each terminal being connected in the series circuit;
(d) a mandrel within the casing having one portion movable relative to another portion;
(e) a fuse element disposed on and between the two mandrel portions and the fuse element being in electrical continuity with the spaced terminals to effect electrical continuity until the fuse element opens;
(f) moving means for moving said one portion;
(g) overload means in the series circuit between the fuse and the transformer; and
(h) an actuating wire connected at one end to the moving means and extending from the interior of the casing to the transformer and in a circuit parallel to the circuit that includes the overload means, whereby when one of the fuse element and overload means opens a current is conducted through the actuating wire to operate the moving means to rupture the fuse element in multiple locations.

2. The system of claim 1 in which a load current flow moves between the fuse to the transformer through the overload device.

3. The system of claim 2 in which the casing comprises ferrules, one ferrule at each end of the casing, and the actuating wire extending through one ferrule and insulated therefrom.

4. The system of claim 3 in which each ferrule comprises one spaced terminal.

5. The system of claim 1 in which when the fuse element opens the current is conducted through the actuating wire.

6. The transformer-fuse system of claim 1 in which the fuse element is fixedly attached to the mandrel.

* * * * *